US007387160B2

(12) United States Patent
O'Shaughnessy et al.

(10) Patent No.: US 7,387,160 B2
(45) Date of Patent: Jun. 17, 2008

(54) USE OF SENSORS WITH WELL TEST EQUIPMENT

(75) Inventors: Paul O'Shaughnessy, Houston, TX (US); Christian Koeniger, Langen (DE)

(73) Assignee: Schlumberger Technology Corporation, Sugar Land, TX (US)

( * ) Notice: Subject to any disclaimer, the term of this patent is extended or adjusted under 35 U.S.C. 154(b) by 94 days.

(21) Appl. No.: 10/547,028

(22) PCT Filed: Feb. 17, 2004

(86) PCT No.: PCT/GB2004/000600

§ 371 (c)(1),
(2), (4) Date: May 3, 2006

(87) PCT Pub. No.: WO2004/076813

PCT Pub. Date: Sep. 10, 2004

(65) Prior Publication Data

US 2006/0225881 A1 Oct. 12, 2006

(30) Foreign Application Priority Data

Feb. 7, 2003 (GB) ..... 0304476.5

(51) Int. Cl.
*E21B 47/00* (2006.01)

(52) U.S. Cl. ..... 166/250.17; 166/250.07

(58) Field of Classification Search ..... None
See application file for complete search history.

(56) References Cited

U.S. PATENT DOCUMENTS

| | | | | |
|---|---|---|---|---|
| 4,222,438 | A | 9/1980 | Hollingsworth et al. | |
| 4,408,485 | A | 10/1983 | McGill | |
| 4,967,853 | A | 11/1990 | Landry | |
| 5,044,437 | A | 9/1991 | Wittrisch | |
| 6,116,340 | A | 9/2000 | Wilson et al. | |
| 6,442,304 | B1 * | 8/2002 | Crawley et al. | 385/12 |
| 6,543,540 | B2 * | 4/2003 | Woie et al. | 166/305.1 |
| 6,745,844 | B2 * | 6/2004 | Henderson | 166/386 |

FOREIGN PATENT DOCUMENTS

| | | | |
|---|---|---|---|
| EP | 0482912 | A1 | 4/1992 |
| EP | 0697501 | A2 | 10/2002 |
| GB | 2405245 | A | 2/2005 |
| WO | 01/33044 | A1 | 5/2001 |

* cited by examiner

*Primary Examiner*—Frank S Tsay
(74) *Attorney, Agent, or Firm*—Diana Sangalli; Kevin B. McGoff; Bryan P. Galloway

(57) ABSTRACT

A method and system used for testing a subterranean well. A sensor (34), such as a distributed temperature sensor, comprising a sensing optical fiber (48) connected to an interrogation unit (50), is deployed together with a drill stem test string (20) so that the sensor extends below the packer of the drill stem test string and across at least one formation (22) of the wellbore.

50 Claims, 3 Drawing Sheets

USE OF SENSORS WITH WELL TEST EQUIPMENT

BACKGROUND

The invention generally relates to subterranean wells. More particularly, the invention relates to the testing of subterranean well formations with the aid of a sensor which may be a distributed temperature sensing system.

Drill stem test strings are used to obtain information from formations in a wellbore, such as information relating to productivity, recoverability, compartmentalization, or fluid properties. Typically, the drill stem test string must be moved from formation to formation in a wellbore since the drill stem test string may not isolate information pertaining to specific formations if it remains in one place. However, moving the drill stem test string not only takes time, but it necessitates unsetting and resetting the string packer which can be problematic and generally requires well kill. The prior art would therefore benefit from a drill stem test string that can obtain information from each of the formations while remaining in a single place.

Production Logging Tools (PLTs) may also be used with drill stem test strings to help obtain or discern the above-identified information from formations in a wellbore. PLTs help to distinguish between information from more than one formation. However, the use of PLTs is expensive. Moreover, high flow rates in a wellbore may prohibit or inhibit the use of PLTs; therefore, in order to use PLTs the wellbore may have to be flowed at a much lower rate than normal thereby providing inaccurate formation information.

Thus, there exists a continuing need for an arrangement and/or technique that addresses one or more of the problems that are stated above.

SUMMARY

According to a first aspect, the present invention provides an apparatus used to test a subterranean wellbore, comprising: a test string adapted to be deployed in a wellbore by a conveyance device; the test string including a packer; a sensor extending below the packer; and the sensor adapted to sense a characteristic below the packer.

The invention further provides that the sensor can extend below the packer across at least one formation of the wellbore.

The invention further provides that the sensor can extend across a plurality of formations.

The invention further provides that the sensor can be adapted to sense a characteristic along the at least one formation.

The invention further provides that the sensor can be a distributed sensor.

The invention further provides that the characteristic can be one of temperature, pressure, flow, strain, or acoustics.

The invention further provides that the sensor can be housed in a control line that extends from the surface below the packer.

The invention further provides that the control line can extend through a bypass port of the packer.

The invention further provides that the control line can extend past the packer through a port of a ported sub.

The invention further provides that the test string is not moved after setting the packer until the test string is retrieved from the wellbore.

The invention further provides that the sensor can comprise a distributed temperature sensor including a sensing optical fiber connected to an interrogation unit.

The invention further provides that the sensing optical fiber can be deployed in a control line.

The invention further provides that the sensing optical fiber can be pumped into the control line by way of fluid drag.

The invention further provides that the control line can include a one-way valve.

The invention further provides that the one-way valve can be proximate a bottom end of the control line.

The invention further provides that the test string can be attached to ported tubing and the ported tubing extends below the packer.

The invention further provides that the sensor can extend along the ported tubing.

The invention further provides that the test string can be attached to at least one perforating gun and the at least one perforating gun extends below the packer.

The invention further provides that the sensor can extend along the at least one perforating gun.

The invention further provides that the sensor can be deployed in a control line; the control line can extend below the packer; and the control line can be attached to an exterior of the at least one perforating gun.

The invention further provides that the at least one perforating gun can include at least one shaped charge; and the control line can be routed along the at least one perforating gun so that the control line is not in a line of fire of any of the at least one shaped charge.

The invention further provides that the control line can be attached to the at least one perforating gun by way of clamps, and each clamp can be located in the line of fire of one of the at least one shaped charge.

The invention further provides that the at least one perforating gun can be adapted to drop from the test string after activation, and the control line can be adapted to remain in place after the activation of the at least one perforating gun.

According to a second aspect, the present invention provides a method for testing a subterranean wellbore, comprising: deploying a test string in a wellbore, the test string including a packer; providing a sensor below the packer; and measuring a characteristic below the packer by use of the sensor.

The invention further provides that the providing step can comprise providing the sensor below the packer across at least one formation of the wellbore.

The invention further provides that the providing step can comprise providing the sensor extends across a plurality of formations.

The invention further provides that the measuring step can comprise measuring a characteristic along the at least one formation.

The invention further provides that the providing step can comprise providing a distributed sensor.

The invention further provides that the measuring step can comprise measuring one of temperature, flow, pressure, strain, or acoustics.

The invention further provides housing the sensor in a control line and extending the control line from the surface below the packer.

The invention further provides that the extending the control line step can comprise extending the control line through a bypass port of the packer.

The invention further provides that the extending the control line step can comprise extending the control line past the packer through a port of a ported sub.

The invention further provides maintaining the test string in place until the test string is retrieved from the wellbore.

The invention further provides that the measuring step can comprise measuring a temperature profile with a sensing optical fiber connected to an interrogation unit.

The invention further provides deploying the sensing optical fiber in a control line.

The invention further provides that the deploying the sensing optical fiber step can comprise pumping the sensing optical fiber into the control line by way of fluid drag.

The invention further provides attaching the test string to ported tubing and extending the ported tubing below the packer.

The invention further provides that the providing step can comprise providing the sensor along the ported tubing.

The invention further provides attaching the test string to at least one perforating gun and extending the at least one perforating gun below the packer.

The invention further provides that the providing step can comprise providing the sensor along the at least one perforating gun.

The invention further provides deploying the sensor in a control line; extending the control line below the packer, and attaching the control line to an exterior of the at least one perforating gun.

The invention further provides that the attaching step can comprise attaching the control line so that the control line is not in a line of fire of the at least one perforating gun.

The invention further provides that the attaching step can comprise attaching the control line to the at least one perforating gun by way of clamps and locating each clamp in a line of fire of the at least one perforating gun.

The invention further provides activating the at least one perforating gun, dropping the at least one perforating gun from the test string after activation, and maintaining the control line in place after the activation of the at least one perforating gun.

According to a third aspect, the present invention comprises a method for testing a subterranean wellbore, comprising: deploying a test string in a wellbore, the test string including a packer, extending a control line from the surface below the packer and across at least one formation of the wellbore; deploying a sensing optical fiber in the control line; and measuring a temperature profile along the plurality of formations by use of the sensing optical fiber.

The invention further provides attaching at least one perforating gun to the test string.

The invention further provides attaching the control line to an exterior of the at least one perforating gun so that the control line is not in a line of fire of the at least one perforating gun.

The invention further provides that the attaching the control line step can comprise attaching the control line to the exterior of the at least one perforating gun by way of clamps and locating the clamps so that each of the clamps is in a line of fire of the at least one perforating gun.

The invention further provides activating the at least one perforating gun, dropping the at least one perforating gun from the test string after activation, and maintaining the control line in place after the activation of the at least one perforating gun.

Advantages and other features of the invention will become apparent from the following description, drawing and claims.

DETAILED DESCRIPTION

Figure 1:
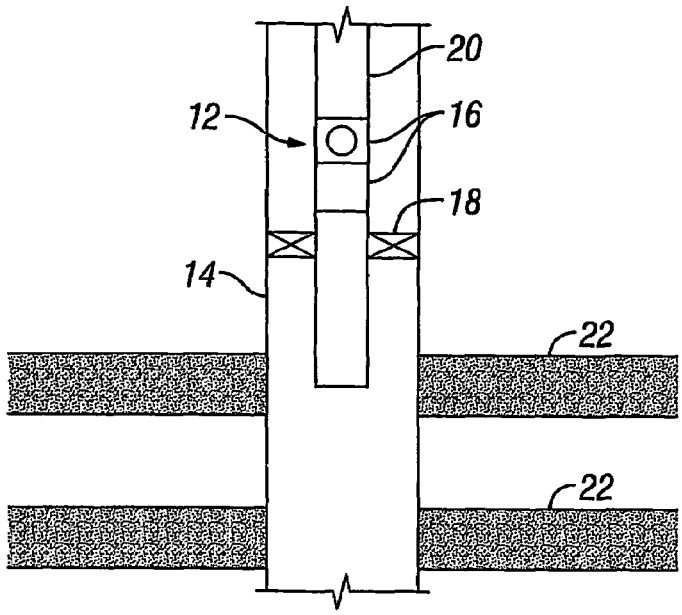
FIG. 1 (Prior Art)
FIG. 1 is a schematic of a prior art DST string.

FIG. 1 shows a prior art drill stem test (DST) string 12. DST strings 12 are generally used to test a wellbore 14 prior to the production of the wellbore 14. The DST string 12 may comprise at least one valve 16 and a resettable packer 18. The DST string 12 is deployed on a conveyance device 20 which may comprise tubing or coiled tubing. Generally, the packer 18 is set above one of the wellbore formations 22 and the valves 16 are activated so that they are open allowing fluid from the relevant formation 22 to pass through the conveyance device 20 to the surface 24. The packer 18 may be then be unset and the DST string 12 moved so that it is above another of the wellbore formations 22 and the process is restarted. In this manner, an operator may obtain valuable information regarding the contents and flow characteristics of each of the formations 22.

The valves 16, which may include a ball valve and a sleeve valve, may be activated by hydraulic signals, such as applied pressure or pressure pulses. The hydraulic signals may be transmitted through the annulus of the wellbore or through the conveyance device 20. Packer 18 may also be activated using similar mechanisms. Valves 16 and packer 18 may alternatively be activated via electric, optical, or acoustic signals.

Figure 2:
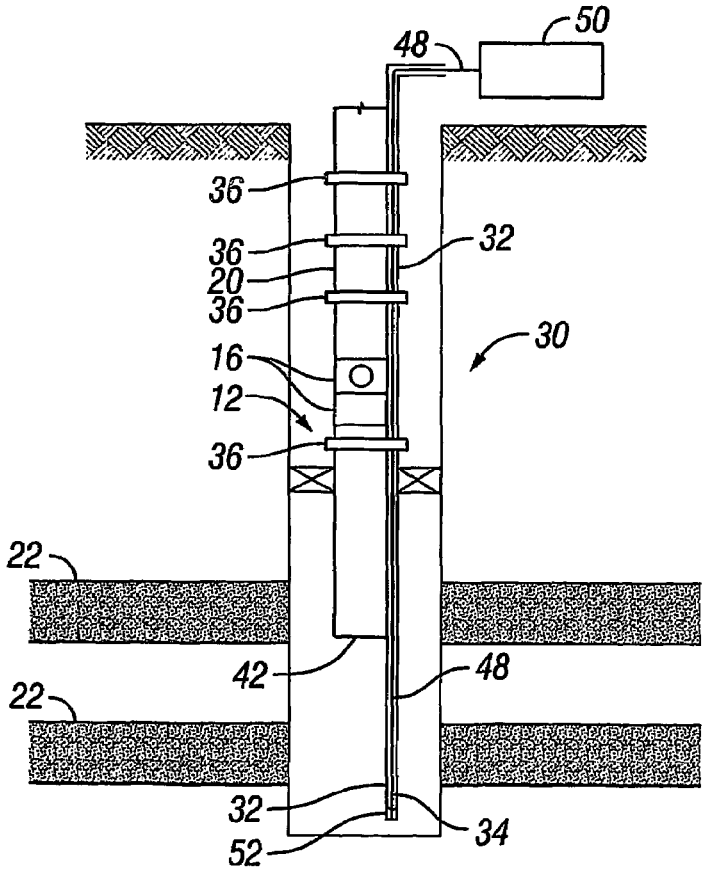
FIG. 2 is a schematic of one embodiment of the present invention.

FIG. 2 shows the system 30 of the present invention. System 30 comprises the prior art DST string 12 as well as a control line 32 that extends below the packer 18 and across at least one formation 22. In one embodiment, control line 32 extends across a plurality of formations 22. A sensor 34 can be deployed within the control line 32 and provides information from below packer 18 and preferably from each of the formations 22 it is across. Unlike the prior art DST string 12 which must be moved to obtain information from each formation 22, system 30 can obtain information from each of the formations 22 in a single trip and without having to be moved.

In one embodiment, sensor 34 can comprise a distributed temperature sensor, a temperature sensor, a pressure sensor, a distributed pressure sensor, a strain sensor, a distributed strain sensor, a flow sensor, a distributed flow sensor, an acoustic sensor, or a distributed acoustic sensor. Sensor 34 can comprise or be deployed on a cable, which may comprise an optical fiber or electrical cable. Sensor 34 is adapted to sense a characteristic along the wellbore, such as physical or chemical characteristics like temperature, flow, pressure, strain, or acoustics.

Figure 3:
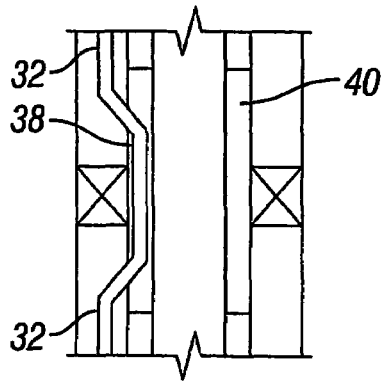
FIG. 3 is a schematic of an alternative means of routing the control line past the DST string packer.

Control line 32 extends along the conveyance device 20, and, in one embodiment, extends along the exterior of the conveyance device 20. In one embodiment, control line 32 is attached to the conveyance device 20 by a plurality of clamps 36. Control line 32 also extends along the exterior of the DST string 12. In one embodiment as shown in FIG. 2, control line 32 extends through a bypass port in packer 18. In another embodiment as shown in FIG. 3, control line 32 extends through a port 38 of a ported sub 40 enabling the control line 32 to extend past the packer 18.

Figure 4:
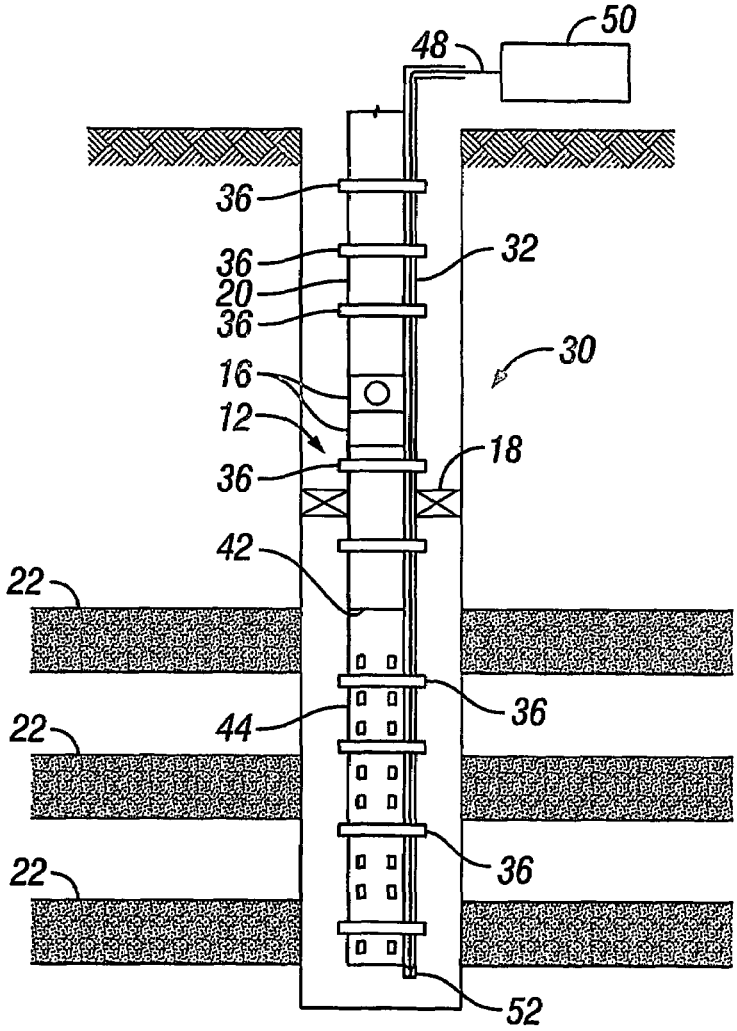
FIG. 4 is a schematic of another embodiment of the present invention, including ported tubing.
Figure 5:
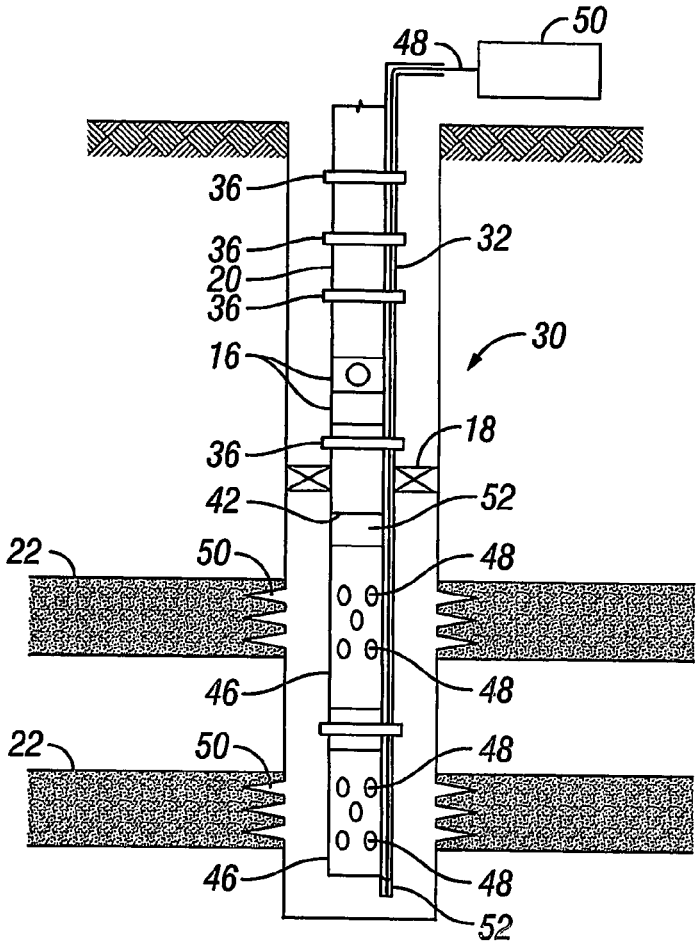
FIG. 5 is a schematic of another embodiment of the present invention, including perforating guns.

DST string 12 has a bottom end 42. In one embodiment as shown in FIG. 2, control line 32 extends past the bottom end 42 by itself. In another embodiment as shown in FIG. 4, ported tubing 44 is connected below the bottom end 42, and the control line 32 is attached to the exterior of the ported tubing 44. In yet another embodiment as shown in FIG. 5, as will be described, at least one perforating gun 46 is connected below the bottom end 42, and the control line 32 is attached to the exterior of the perforating gun 46.

In one embodiment, sensor 34 comprises a distributed temperature sensor such as a sensing optical fiber 48 connected to an interrogation unit 50 located at the surface of the wellbore 14. The optical fiber 48 may be used together with the interrogation unit 50 to provide a distributed temperature profile along the length of the optical fiber 48. Interrogation unit 50 may include a processor and a light source. In some embodiments of the invention, the temperature measurement system uses an optical time domain reflectometry (OTDR) technique to measure a temperature distribution along a region (the entire length, for example) of the optical fiber 48. Thus, the temperature measurement system is capable of providing a spatial distribution of thousands of temperatures measured in a region of the well along which the optical fiber 48 extends.

More specifically, pursuant to the OTDR technique, temperature measurements may be made by introducing optical energy into the optical fiber by the interrogation unit 50 at the surface of the well. The optical energy that is introduced into the optical fiber 48 produces backscattered light The phrase "backscattered light" refers to the optical energy that returns at various points along the optical fiber 48 back to the interrogation unit 50 at the surface of the well. More specifically, in accordance with OTDR, a pulse of optical energy typically is introduced to the optical fiber 48, and the resultant backscattered optical energy that returns from the fiber 48 to the surface is observed as a function of time. The time at which the backscattered light propagates from the various points along the fiber 48 to the surface is proportional to the distance along the fiber 48 from which the backscattered light is received.

In a uniform optical fiber 48, the intensity of the backscattered light as observed from the surface of the well exhibits an exponential decay with time. Therefore, knowing the speed of light in the fiber 48 yields the distances that the light has traveled along the fiber 48. Variations in the temperature show up as variations from a perfect exponential decay of intensity with distance. Thus, these variations are used to derive the distribution of temperature along the optical fiber 48.

In the frequency domain, the backscattered light includes the Rayleigh spectrum, the Brillouin spectrum and the Raman spectrum. The Raman spectrum is the most temperature sensitive with the intensity of the spectrum varying with temperature, although all three spectrums of the backscattered light contain temperature information. The Raman spectrum typically is observed to obtain a temperature distribution from the backscattered light.

In summary, the processor may control the light source so that the light source emits pulses of light at a predefined wavelength (a Stokes wavelength, for example) into the optical fiber 48. In response to the pulses of light, backscattered light is produced by the optical fiber 48, and this backscattered light returns to the interrogation unit 50. The interrogation unit 50, in turn, measures the intensity of the resultant backscattered light at the predefined wavelength. Using OTDR techniques, the processor processes the intensities that are detected by the interrogation unit 50 to calculate the temperature distribution along some portion (the entire length, for example) of the optical fiber 48.

This distributed temperature profile enables the operator to have a profile of the temperature across the formations 22. This temperature profile may be used to determine or infer, among other things, the flow characteristics of the wellbore, including the presence of flow, the location of formations, or whether such formations are producing or not.

In one embodiment, the optical fiber 48 (or other cable) may be deployed within control line 32 by being pumped through control line 32. This technique is described in U.S. Reissue Pat. No. 37,283. Essentially, the optical fiber 48 is dragged along the control line 32 by the injection of a fluid at the surface. The fluid and induced injection pressure work to drag the optical fiber 48 along the control line 32. In one embodiment, control line 32 includes a one-way valve 52 at its bottom end, which one-way valve 52 enables the pumping fluid to continuously escape the control line 32. In another embodiment (not shown), the control line 32 has a U-shape so that it returns to the surface, which configuration would necessitate a second bypass port through packer 18 or a second port through ported sub. In yet another embodiment (not shown), the control line 32 has a J-shape, which configuration may necessitate a second bypass port through packer 18 or a second port through ported sub, depending on the where the operator wishes the far end of the J-shape to terminate. This fluid drag pumping technique may also be used to remove the optical fiber 48 from the control line 20 (such as if the optical fiber 48 fails) and then to replace it with a new, properly-functioning optical fiber 48. In this replacement scenario and in the embodiment including the one-way valve 52, the one-way valve 52 is also configured to enable the release of the optical fiber 48 therethrough.

In another embodiment, the optical fiber 48 (or other cable) is already housed within the control line 32 when the control line 32 is deployed or assembled to the string.

It is noted that in the embodiment in which the control line 32 has a u-shape or J-shape, the optical fiber 48 may extend throughout the entire length of the control line 32. This embodiment increases the resolution of a single-ended system.

Figure 6:
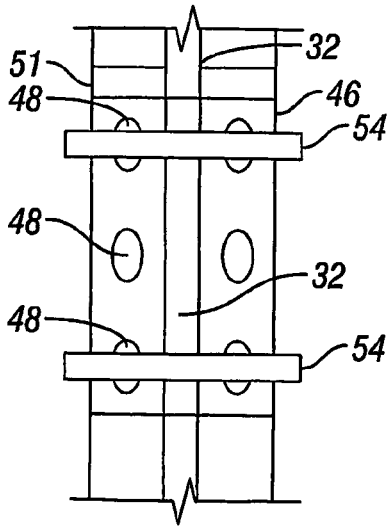
FIG. 6 is a schematic of the present invention in which the clamps are broken upon the activation of the perforating guns.

As previously disclosed and as shown in FIG. 5, at least one perforating gun 46 may be attached to the bottom of the DST string 12. As known in the prior art, perforating guns 46 include shape charges 48 that are activated to create perforations 50 in the wellbore 14 along the formations 22. The shape charges 48 may be activated by hydraulic signals, electrical signals, optical signals, or percussion blows. The perforations 50 aid in establishing and maintaining the flow of hydrocarbons from the formations 22 into the wellbore 14. As shown in FIG. 6, in one embodiment, control line 32 is routed along the exterior of the perforating guns 46 so that it is not in the firing line of any of the shaped charges 48.

Typically, the DST string 12 with the perforating guns 46 is deployed in the wellbore 14. The perforating guns 46 are activated first, which depending on the relative pressures between the formations 22 and the wellbore 14 may immediately cause hydrocarbons to flow from the formations 22 through the DST string 12 (as long as the valves 16 are open) and to the surface.

It is sometimes preferable, however, for the perforating guns 46 to automatically disengage and drop from the DST string 12. Normally this disengagement is enabled by a disengagement component 51 which disintegrates or separates immediately after the activation of the perforating guns 46.

If control line 32 is extended along the exterior of the perforating guns 46, it is important not to break or damage control line 32 when the perforating guns 46 are dropped from the DST string 12. To prevent this and as shown in FIG. 6, the control line 32 may be attached to the perforating guns 46 with clamps 54 that are arranged so that each clamp 54 is in the firing line of at least one shaped charge 48. Thus, when the perforating guns 46 are activated, the shaped charges 48 will break the clamps 54, and, when the perforating gun 46 disengages from the DST string 12, the control line 32 will already be disengaged from the perforating guns 46. The perforating guns 46 will therefore harmlessly fall to the bottom of the wellbore along with the clamps 54 leaving the control line 32 suspended from the DST string 12 and extending across the formations 22.

While the invention has been disclosed with respect to a limited number of embodiments, those skilled in the art, having the benefit of this disclosure, will appreciate numerous modifications and variations therefrom. It is intended that the appended claims cover all such modifications and variations as fall within the true spirit and scope of the invention.

We claim:

1. An apparatus used to test a subterranean wellbore, comprising:

a test string adapted to be deployed in a wellbore by a conveyance device;

the test string including a packer;

a sensor extending below the packer; and the sensor adapted to sense a characteristic, wherein the test string is attached to ported tubing and the ported tubing extends below the packer.

2. The apparatus of claim 1, wherein the sensor extends below the packer across at least one formation of the wellbore.

3. The apparatus of claim 2, wherein the sensor extends across a plurality of formations.

4. The apparatus of claim 2, wherein the sensor is adapted to sense a characteristic along the at least one formation.

5. The apparatus of claim 1, wherein the sensor is a distributed sensor.

6. The apparatus of claim 5, wherein the distributed sensor extends across a plurality of formations.

7. The apparatus of claim 5, wherein the characteristic is one of temperature, pressure, flow, strain, or acoustics.

8. The apparatus of claim 1, wherein the characteristic is one of temperature, pressure, flow, strain, or acoustics.

9. The apparatus of claim 1, wherein the sensor is housed in a control line that extends from the surface below the packer.

10. The apparatus of claim 9, wherein the control line extends through a bypass port of the packer.

11. The apparatus of claim 9, wherein the control line extends past the packer through a port of a ported sub.

12. The apparatus of claim 1, wherein the test string is not moved after setting the packer until the test string is retrieved from the wellbore.

13. The apparatus of claim 1, wherein the sensor comprises a distributed temperature sensor including a sensing optical fiber connected to an interrogation unit.

14. The apparatus of claim 13, wherein the sensing optical fiber is deployed in a control line.

15. An apparatus used to test a subterranean wellbore, comprising:

a test string adapted to be deployed in a wellbore by a conveyance device;

the test string including a packer;

a sensor extending below the packer;

the sensor adapted to sense a characteristic below the packer, wherein the sensor comprises a distributed temperature sensor including a sensing optical fiber connected to an interrogation unit, wherein the sensing optical fiber is deployed in a control line, and wherein the sensing optical fiber is pumped into the control line by way of fluid drag.

16. The apparatus of claim 15, wherein the control line includes a one-way valve.

17. The apparatus of claim 16, wherein the one-way valve is proximate a bottom end of the control line.

18. The apparatus of claim 1, wherein the sensor extends along the ported tubing.

19. An apparatus used to test a subterranean wellbore, comprising:

a test string adapted to be deployed in a wellbore by a conveyance device;

the test string including a packer;

a sensor extending below the packer; and the sensor adapted to sense a characteristic below the packer, wherein the test string is attached to at least one perforating gun and the at least one perforating gun extends below the packer.

20. The apparatus of claim 19, wherein the sensor extends along the at least one perforating gun.

21. The apparatus of claim 19, wherein:

the sensor is deployed in a control line;

the control line extends below the packer; and the control line is attached to an exterior of the at least one perforating gun.

22. The apparatus of claim 21, wherein:

the at least one perforating gun includes at least one shaped charge; and the control line is routed along the at least one perforating gun so that the control line is not in a line of fire of any of the at least one shaped charge.

23. The apparatus of claim 22, wherein the control line is attached to the at least one perforating gun by way of clamps, and each clamp is located in the line of fire of one of the at least one shaped charge.

24. The apparatus of claim 21, wherein the at least one perforating gun is adapted to drop from the test string after activation, and the control line is adapted to remain in place after the activation of the at least one perforating gun.

25. A method for testing a subterranean wellbore, comprising:

deploying a test string in a wellbore, the test string including a packer;

attaching the test string to ported tubing;

extending the ported tubing below the packer;

providing a sensor below the packer; and measuring a characteristic below the packer by use of the sensor.

26. The method of claim 25, wherein the providing step comprises providing the sensor below the packer across at least one formation of the wellbore.

27. The method of claim 26, wherein the providing step comprises providing the sensor extends across a plurality of formations.

28. The method of claim 26, wherein the measuring step comprises measuring a characteristic along the at least one formation.

29. The method of claim 25, wherein the providing step comprises providing a distributed sensor.

30. The method of claim 29, wherein the providing step comprises providing the distributed sensor across a plurality of formations.

31. The method of claim 29, wherein the measuring step comprises measuring one of temperature, flow, pressure, strain, or acoustics.

32. The method of claim 25, wherein the measuring step comprises measuring one of temperature, flow, pressure, strain, or acoustics.

33. The method of claim 25, further comprising housing the sensor in a control line and extending the control line from the surface below the packer.

34. The method of claim 33, wherein the extending the control line step comprises extending the control line through a bypass port of the packer.

35. The method of claim 33, wherein the extending the control line step comprises extending the control line past the packer through a port of a ported sub.

36. The method of claim 25, further comprising maintaining the test string in place until the test string is retrieved from the wellbore.

37. The method of claim 25, wherein the measuring step comprises measuring a temperature profile with a sensing optical fiber connected to an interrogation unit.

38. The method of claim 37, further comprising deploying the sensing optical fiber in a control line.

39. A method for testing a subterranean wellbore, comprising:

deploying a test string in a wellbore, the test string including a packer;

providing a sensor below the packer;

measuring a characteristic below the packer by use of the sensor, the sensor comprising a sensing optical fiber connected to an interrogation unit; and deploying the sensing optical fiber in a control line, wherein the measuring step comprises measuring a temperature profile with the sensing optical fiber, and wherein the deploying the sensing optical fiber step comprises pumping the sensing optical fiber into the control line by way of fluid drag.

40. The method of claim 25, wherein the providing step comprises providing the sensor along the ported tubing.

41. A method for testing a subterranean wellbore, comprising:

deploying a test string in a wellbore, the test string including a packer;

providing a sensor below the packer;

measuring a characteristic below the packer by use of the sensor; and attaching the test string to at least one perforating gun and extending the at least one perforating gun below the packer.

42. The method of claim 41, wherein the providing step comprises providing the sensor along the at least one perforating gun.

43. The method of claim 41, further comprising:

deploying the sensor in a control line;

extending the control line below the packer; and attaching the control line to an exterior of the at least one perforating gun.

44. The method of claim 43, wherein the attaching step comprises attaching the control line so that the control line is not in a line of fire of the at least one perforating gun.

45. The method of claim 44, wherein the attaching step comprises attaching the control line to the at least one perforating gun by way of clamps and locating each clamp in a line of fire of the at least one perforating gun.

46. The method of claim 43, further comprising activating the at least one perforating gun, dropping the at least one perforating gun from the test string after activation, and maintaining the control line in place after the activation of the at least one perforating gun.

47. A method for testing a subterranean wellbore, comprising:

deploying a test string in a wellbore, the test string including a packer;

extending a control line from the surface below the packer and across at least one formation of the wellbore;

deploying a sensing optical fiber in the control line;

measuring a temperature profile along the plurality of formations by use of the sensing optical fiber; and attaching at least one perforating gun to the test string.

48. The method of claim 47, further comprising attaching the control line to an exterior of the at least one perforating gun so that the control line is not in a line of fire of the at least one perforating gun.

49. The method of claim 48, wherein the attaching the control line step comprises attaching the control line to the exterior of the at least one perforating gun by way of clamps and locating the clamps so that each of the clamps is in a line of fire of the at least one perforating gun.

50. The method of claim 47, further comprising activating the at least one perforating gun, dropping the at least one perforating gun from the test string after activation, and maintaining the control line in place after the activation of the at least one perforating gun.

* * * * *